US009284719B2

(12) United States Patent
Lim et al.

(10) Patent No.: US 9,284,719 B2
(45) Date of Patent: Mar. 15, 2016

(54) HYDRAULIC SYSTEM FOR CONSTRUCTION MACHINE HAVING ELECTRONIC HYDRAULIC PUMP

(75) Inventors: Hyun Sik Lim, Incheon (KR); Woo Yong Jung, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 353 days.

(21) Appl. No.: 13/981,161

(22) PCT Filed: Dec. 26, 2011

(86) PCT No.: PCT/KR2011/010081
§ 371 (c)(1),
(2), (4) Date: Jul. 23, 2013

(87) PCT Pub. No.: WO2012/102488
PCT Pub. Date: Aug. 2, 2012

(65) Prior Publication Data

US 2013/0312403 A1 Nov. 28, 2013

(30) Foreign Application Priority Data

Jan. 24, 2011 (KR) ..... 10-2011-0007073

(51) Int. Cl.
*E02F 9/22* (2006.01)
*F15B 20/00* (2006.01)
*E02F 9/26* (2006.01)

(52) U.S. Cl.
CPC ..... *E02F 9/2292* (2013.01); *E02F 9/226* (2013.01); *E02F 9/2235* (2013.01); (Continued)

(58) Field of Classification Search
CPC ..... E02F 9/268; E02F 9/226; E02F 9/2282; E02F 9/2292; E02F 9/2235; E02F 9/2242; E02F 9/2296; F15B 20/002; F15B 2211/8752; F15B 2211/20546; F15B 2211/20576; F15B 2211/3116
USPC ..... 60/403
See application file for complete search history.

(56) References Cited

U.S. PATENT DOCUMENTS 5,077,973 A 1/1992 Suzuki et al.
5,138,838 A 8/1992 Crosser
(Continued)

FOREIGN PATENT DOCUMENTS

CN 101802417 A 8/2010
JP 06-213205 8/1994
(Continued)

OTHER PUBLICATIONS

Extended European Search Report dated Nov. 10, 2014 for corresponding European Application No. 118566946, 7 pages.
(Continued)

*Primary Examiner* — Dwayne J White
*Assistant Examiner* — Logan Kraft
(74) *Attorney, Agent, or Firm* — John D. Veldhuis-Kroeze; Westman, Champlin & Koehler, P.A.

(57) ABSTRACT

The present disclosure relates to a hydraulic system for a construction machine having an electronic hydraulic pump, and more particularly, to a hydraulic system which temporarily drives the construction machine when an operation of an electronic control unit controlling an electronic hydraulic pump is abnormal, particularly, when the electronic control unit is not able to perform a control because an operative amount of a joystick input to the electronic control unit is not normally transmitted to the electronic control unit.

5 Claims, 4 Drawing Sheets

(52) U.S. Cl.
CPC ..... *E02F 9/2242* (2013.01); *E02F 9/2282* (2013.01); *E02F 9/2296* (2013.01); *E02F 9/268* (2013.01); *F15B 20/002* (2013.01); *F15B 2211/20546* (2013.01); *F15B 2211/20576* (2013.01); *F15B 2211/3116* (2013.01); *F15B 2211/8752* (2013.01)

(56) References Cited

U.S. PATENT DOCUMENTS

| | | | | |
|---|---|---|---|---|
| 7,028,659 | B2 * | 4/2006 | Schneider | F01M 1/02 123/196 R |
| 9,016,312 | B2 * | 4/2015 | Yun | E02F 9/2235 137/602 |

FOREIGN PATENT DOCUMENTS

| | | | |
|---|---|---|---|
| JP | H07133808 | A | 5/1995 |
| JP | H09324443 | A | 12/1997 |
| JP | H10174512 | A | 6/1998 |
| JP | 2000-282515 | | 10/2000 |
| JP | H2006097855 | A | 4/2006 |
| JP | 2006-162058 | | 6/2006 |
| JP | 2010286116 | A | 12/2010 |
| KR | 10-2010-0134332 | | 12/2010 |
| WO | 2009084853 | A2 | 7/2009 |

OTHER PUBLICATIONS

Chinese Office Action dated Dec. 23, 2014 for corresponding Chinese Application No. 201180065660.2, 5 pages.

Search Report dated Aug. 24, 2012 written in Korean with English translation attached for International Patent Application No. PCT/KR2011/010081 filed Dec. 26, 2011, 5 pages.

* cited by examiner

HYDRAULIC SYSTEM FOR CONSTRUCTION MACHINE HAVING ELECTRONIC HYDRAULIC PUMP

CROSS-REFERENCE TO RELATED APPLICATION

This Application is a Section 371 National Stage Application of International Application No. PCT/KR2011/010081, filed Dec. 26, 2011 and published, not in English, as WO2012/102488 on Aug. 2, 2012.

FIELD OF THE DISCLOSURE

The present disclosure relates to a hydraulic system for a construction machine having an electronic hydraulic pump, and more particularly, to a hydraulic system which temporarily drives the construction machine when an operation of an electronic control unit controlling an electronic hydraulic pump is abnormal, particularly, when the electronic control unit is not able to perform a control because an operative amount of a joystick input to the electronic control unit is not normally transmitted to the electronic control unit.

BACKGROUND OF THE DISCLOSURE

A construction machine, such as an excavator and a wheel loader, generally includes a hydraulic pump driven by an engine, and a hydraulic system for driving a plurality or working machines, such as a boom, an arm, a bucket, a travel motor, and a turning motor, through pressure of working oil discharged from the hydraulic pump.

The hydraulic pump used in the hydraulic system for the construction machine is a variable capacity type pump including a swash plate formed inside the pump and an adjusting device for adjusting a swash plate angle (swash plate angle), and particularly, may be divided into a machine control type or an electronic control type according to a type of an instruction input to the adjusting device in order to adjust the swash plate angle.

The initial hydraulic pump mainly employs the machine control method, but the electronic control type for controlling the swash plate angle by applying an electric signal to the adjusting device has been introduced today. The hydraulic pump of the electronic control type includes a so-called pressure control type electric hydraulic pump.

The pressure control type electric hydraulic pump is controlled by a control means, such as an electronic control unit. The electronic control unit receives an operative amount of a joystick according to an operation of a lever, such as a joystick within an operation seat of the construction machine and a value of a swash plate angle from a sensor mounted inside the electronic hydraulic pump as electric signals, respectively, and outputs the electric signal for controlling the pressure to the corresponding electronic hydraulic pump.

However, in a case of the construction machine using the electronic hydraulic pump, when the electronic control unit fails to be operated, for example, when an operation signal (the operative amount) of the joystick, which is input to the electronic control unit, is not normally input, there may occur a problem in that the electronic control unit is not able to normally control the electronic hydraulic pump.

As described above, when the construction machine is controlled, the electronic control unit may arbitrarily intend to maintain a uniform pump pressure even when an operation signal input to the electronic control unit is abnormal, thereby leading to problems such as an increase in noise of equipment, for example, the pump, of the construction machine, a decrease in durability of hydraulic components, such as the hydraulic pump or a valve, and an increase in fuel consumption and a decrease in durability of an engine due to maintenance of the engine in a continuous high load state.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

An object of the present disclosure is to provide a hydraulic system for a construction machine which temporarily emergency controls an electronic hydraulic pump by an electronic control unit in a case where an operation signal input to the electronic control unit is abnormal in a construction machine using the electronic hydraulic pump.

Another object of the present disclosure is to provide a hydraulic system of a construction machine which, in a case where a joystick is in a neutral state during an emergency control, recognizes the neutral state of the joystick and appropriately controls a swash plate angle in response to the neutral state of the joystick.

Yet another object of the present disclosure is to provide a hydraulic system configured to, for example, be able to recognize a neutral state of a joystick even in a case where an operation signal of the joystick is abnormal.

In order to achieve the above object, the present disclosure provides a hydraulic system for a construction machine including: electronic hydraulic pumps which are pressure control type variable capacity pumps; a plurality of main control valves configured to selectively control a movement of working oil discharged from the electronic hydraulic pumps; a plurality of working machines and travel motors driven with working oil supplied from each corresponding main control valve among the plurality of main control valves; and an electronic control unit configured to control a discharge flow rate of the working oil of the electronic hydraulic pumps based on flow rate signals of the electronic hydraulic pumps and an operative amount of the joystick, in which when the electronic control unit is not able to perform a normal control due to a failure of transmittance of the operative amount of the joystick to the electronic control unit, the electronic control unit performs an emergency control of permitting the electronic hydraulic pumps to discharge the working oil at a maximum pressure, by outputting predetermined pressure control signals to the electronic hydraulic pumps, and performs a predetermined control of a swash plate angle for permitting the electronic hydraulic pumps to discharge the working oil with a predetermined flow rate and at a minimum pressure when the joystick is in a neutral state during the emergency control.

In the present disclosure, the hydraulic system may further include center bypass valves generally closed during the normal control of the electronic control unit, and the electronic control unit may switch a type of the hydraulic system to an open type by operating the center bypass valves when the electronic control unit is not able to perform the normal control.

Further, in the present disclosure, in the open-type system switched according to the operation of the center bypass valves, when the electronic hydraulic pumps have a pressure equal to or higher than a predetermined reference pressure and maintain a maximum swash plate angle for a predetermined reference time, the electronic control unit may recognize that the joystick is in a neutral state.

Further, in the present disclosure, the predetermined control of the swash plate angle may be performed so that the pressures of the electronic hydraulic pumps become a minimum pressure by permitting the electronic hydraulic pumps to discharge working oil at a predetermined flow rate according to the recognition of the neutral state of the joystick.

Further, in the present disclosure, according to a release from the neutral state of the joystick, the pressures of the electronic hydraulic pumps are increased, and when the increased pressure is equal to or higher than a predetermined pressure, the electronic control unit stops the predetermined control of the swash plate angle to permit the electronic hydraulic pumps to discharge the working oil with the maximum pressure again.

According to the present disclosure, it is possible to provide the hydraulic system for the construction machine in which the electronic control unit temporarily emergency controls the electronic hydraulic pumps in a case where the pressure sensor of the joystick has a failure in the construction machine using the electronic hydraulic pumps.

Further, according to the present disclosure, it is possible to provide the hydraulic system for the construction machine which, in a case where the joystick is in a neutral state during the aforementioned emergency control, recognizes the neutral state of the joystick and appropriately controls an angle of a swash plate in response to the neutral state of the joystick.

Further, according to the present disclosure, it is possible to provide the hydraulic system configured so that the electronic control unit may recognize the neutral state of the joystick even though the operative amount of the joystick is not transmitted to the electronic control unit.

Further, according to the hydraulic system of the present disclosure, it is possible to solve problems, such as an increase in noise of equipment of the construction machine, for example, the pump, a decrease in durability of hydraulic components, such as the hydraulic pump or the valve, and an increase in fuel consumption and a decrease in durability of an engine due to maintenance of the engine with a continuous high load state by performing an appropriate control of a swash plate angle in the neutral state of the joystick.

DESCRIPTION OF MAIN REFERENCE NUMERALS OF DRAWINGS

200: Hydraulic system
110*a*, 110*b*: Electronic hydraulic pump
110*c*: Gear pump
112*a*, 112*b*: Adjusting device
114*a*, 114*b*: Hydraulic line
116*a*, 116*b*: Flow rate signal
120*a*, 120*b*, 120*c*, 120*d*: Main control valve
130*a*, 130*b*: Travel motor
140*a*, 140*b*: Working machine
150: Electronic control unit
152*a*, 152*b*, 154: Control signal
160: Pressure sensor
162: Pressure signal
170*a*, 170*b*: Center bypass valve
172: Center bypass control valve (solenoid valve)
180*a*, 180*b*: Pressure sensor
182*a*, 182*b*: Pump pressure signal

DETAILED DESCRIPTION

As described above, the present disclosure relates to a hydraulic system of a construction machine capable of emergency controlling the construction machine in an assumed case where an input signal of a joystick, among input signals (a flow rate signal and a pressure signal) transmitted to an electronic control unit, fails to be transmitted to the electronic control unit. For example, since, for example, only a pressure sensor for transmitting an operative amount of the joystick to the electronic control unit has a failure, it is noted that a pilot pressure output from the joystick to each main control valve and the like is normally transmitted, and also the pressure may be variably controlled for each electronic hydraulic pump.

In the meantime, in the specification, the pressure sensor is exemplified as a means for transmitting an operative amount of the joystick to the electronic control unit, but is illustrative only, and it is obvious that other appropriate means may be used. For example, it is noted that an electronic-hydraulic common use joystick may be used or a separate operative amount measuring means may be provided on the joystick.

Hereinafter, an exemplary embodiment of the present disclosure will be described with reference to the accompanying drawings.

The present disclosure relates to a hydraulic system of a construction machine capable of emergency controlling the construction machine in the construction machine having an electronic hydraulic pump, particularly, in an assumed case where an input signal of a joystick among input signals transmitted to an electronic control unit fails to be transmitted. In this case, since a means for transmitting the operative amount of the joystick, for example, only the pressure sensor, has a failure, it is noted that a pilot pressure output from the joystick to each main control valve and the like is normally transmitted.

Figure 1:
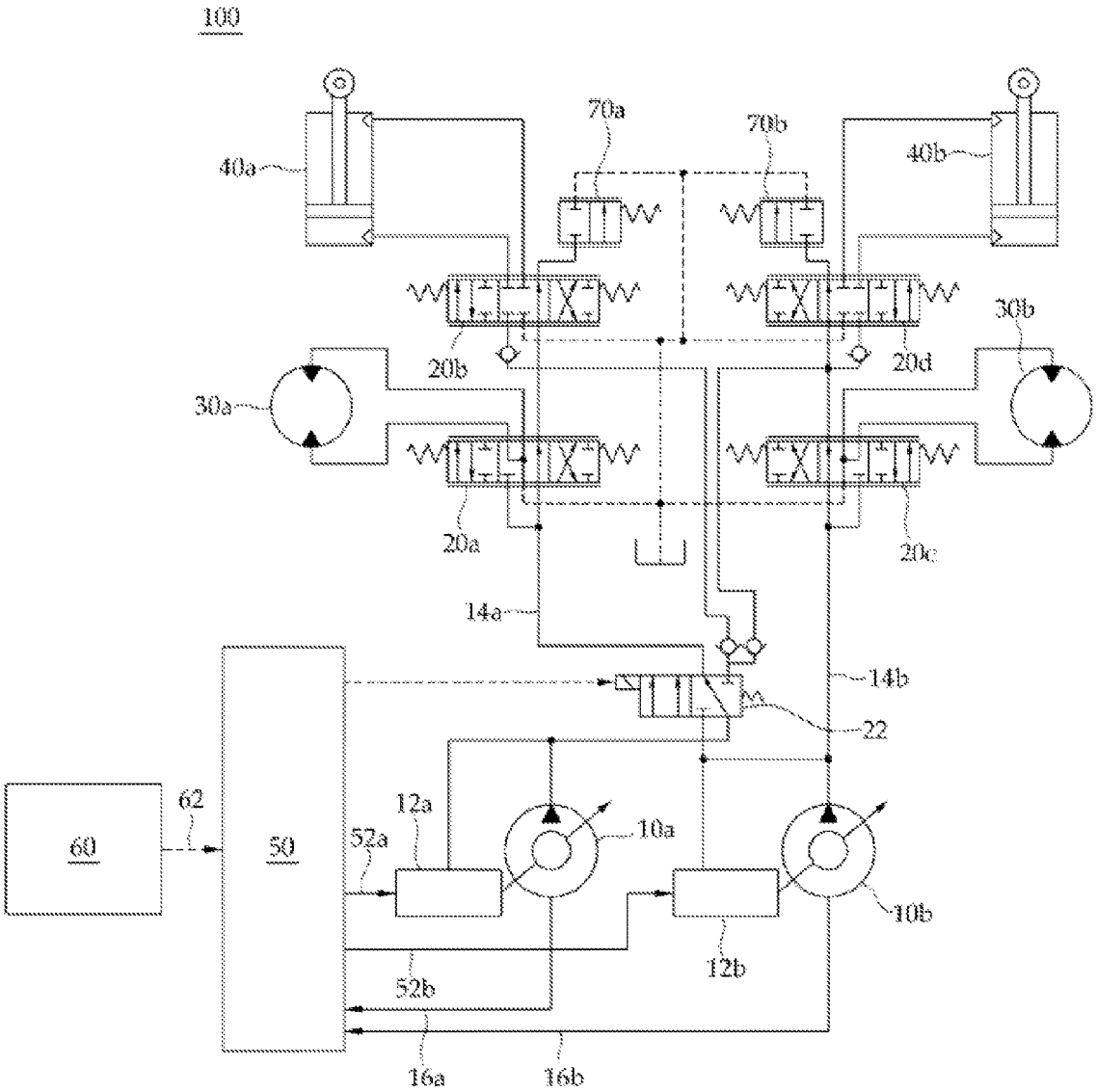
FIG. 1 is a hydraulic circuit diagram illustrating an example of a hydraulic system using an electronic hydraulic pump.

FIG. 1 is a hydraulic circuit diagram illustrating an example of a hydraulic system using an electric hydraulic pump in the related art. Referring to FIG. 1, a hydraulic system 100 for a construction machine includes electronic hydraulic pumps 10*a* and 10*b* driven by an engine (not illustrated), a plurality of main control valves 20*a*, 20*b*, 20*c*, and 20*d* controlling a movement of working oil discharged from the electronic hydraulic pumps, and travel motors 30*a* and 30*b* and a plurality of working machines 40*a* and 40*b* driven with working oil supplied from the respective main control valves. Further, the hydraulic system 100 for the construction machine includes predetermined hydraulic lines 14*a* and 14*b* forming paths through which the working oil is transferred, by connecting the pumps, the main control valves, the working machines, and the like, and further includes a straight travel control valve 22, which may change a supply path of the working oil for the travel motors 30*a* and 30*b* and the working machines 40*a* and 40*b*, on the hydraulic line between the electronic hydraulic pumps 10*a* and 10*b* and the main control valves 20*a*, 20*b*, 20*c*, and 20*d*.

Further, the hydraulic system 100 for the construction machine includes adjusting devices 12*a* and 12*b* for adjusting swash plate angles of the electronic hydraulic pumps 10*a* and 10*b*, and an electronic control unit 50 capable of controlling the adjusting devices, and the electronic control unit 50 receives a pressure signal 62 from a pressure sensor 60 of a joystick and flow rate signals (for example, angle detection signal of the swash plate angle) 16*a* and 16*b* of the respective pumps 10*a* and 10*b* and outputs corresponding control signals 52*a* and 52*b* to the adjusting devices 12*a* and 12*b* of the pumps. Further, the hydraulic system 100 is operated as a close-type system in which center bypass valves 70*a* and 70*b* are closed.

For example, when an operative amount of the joystick (for example, the pressure signal 62 of the pressure sensor) fails to be transmitted to the electronic control unit 50 in the hydraulic system, the electronic control unit 50 is not able to normally output the control signals 52*a* and 52*b* for the respective electronic hydraulic pumps, and the electronic control unit 50 outputs control signals (pressure commands) with a predetermined constant to the respective electronic hydraulic pumps 10*a* and 10*b* during an abnormal operation, so that the respective electronic hydraulic pumps 10*a* and 10*b* are set to maintain a predetermined pressure for emergency driving of the construction machine. That is, the working oil is set to be discharged at a predetermined pressure from the electronic hydraulic pumps 10*a* and 10*b*.

Figure 2:
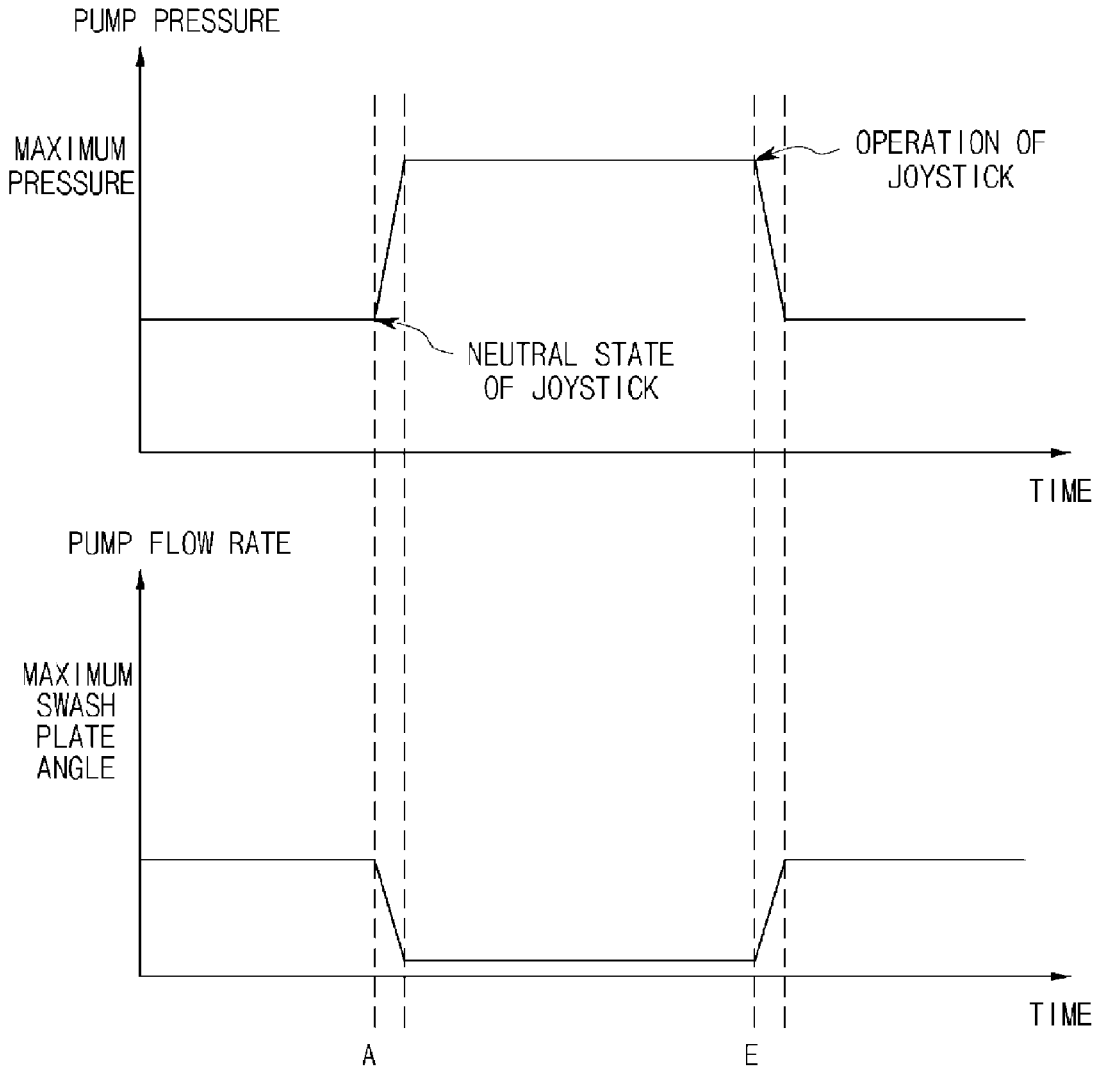
FIG. 2 is a graph illustrating a relationship between a pressure and a flow rate of the electronic hydraulic pump for a time in the system of FIG. 1.

FIG. 2 is a graph illustrating a relationship between a pressure and a flow rate of the pump for a time in the system of FIG. 1. An emergency control mode will be described with reference to FIG. 2.

For example, during the emergency control of the electronic control unit generated due to a failure of the transmittance of the operative amount of the joystick, the electronic control unit outputs control signals with predetermined constants to the respective electronic hydraulic pumps, so that the working oil having a predetermined pressure is set to be discharged in a close-type system formed by closing the center bypass valves. Through this, the respective electronic hydraulic pumps maintain a high pressure, thereby performing load work.

In this case, when the driving of the working machine and the like is stopped so that the joystick is in a neutral state as indicated with time A in FIG. 2, the working oil is continuously discharged in a closed-type system, and as a result, when a pressure of the electronic hydraulic pump (that is, a discharge pressure of the working oil) is gradually increased to reach a maximum pressure, for example, the maximum pressure is continuously maintained until the joystick is operated again as indicated with time E in FIG. 2. Further, the swash plate angle of each electronic hydraulic pump is minimally maintained while the pressure of the electronic hydraulic pump is maintained at the maximum pressure.

Figure 3:
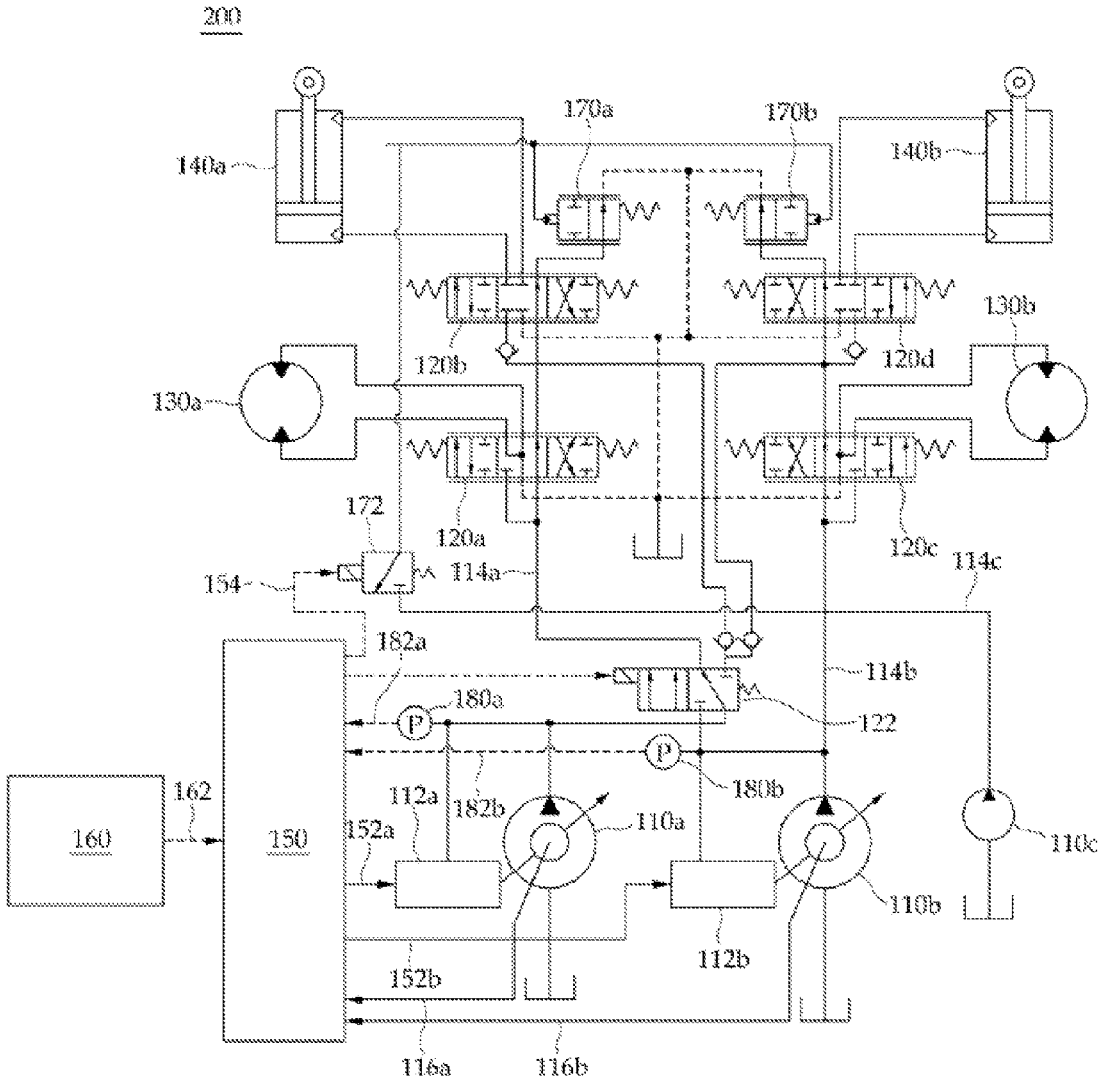
FIG. 3 is a hydraulic circuit diagram illustrating a hydraulic system using an electric hydraulic pump according to an exemplary embodiment of the present disclosure.
Figure 4:
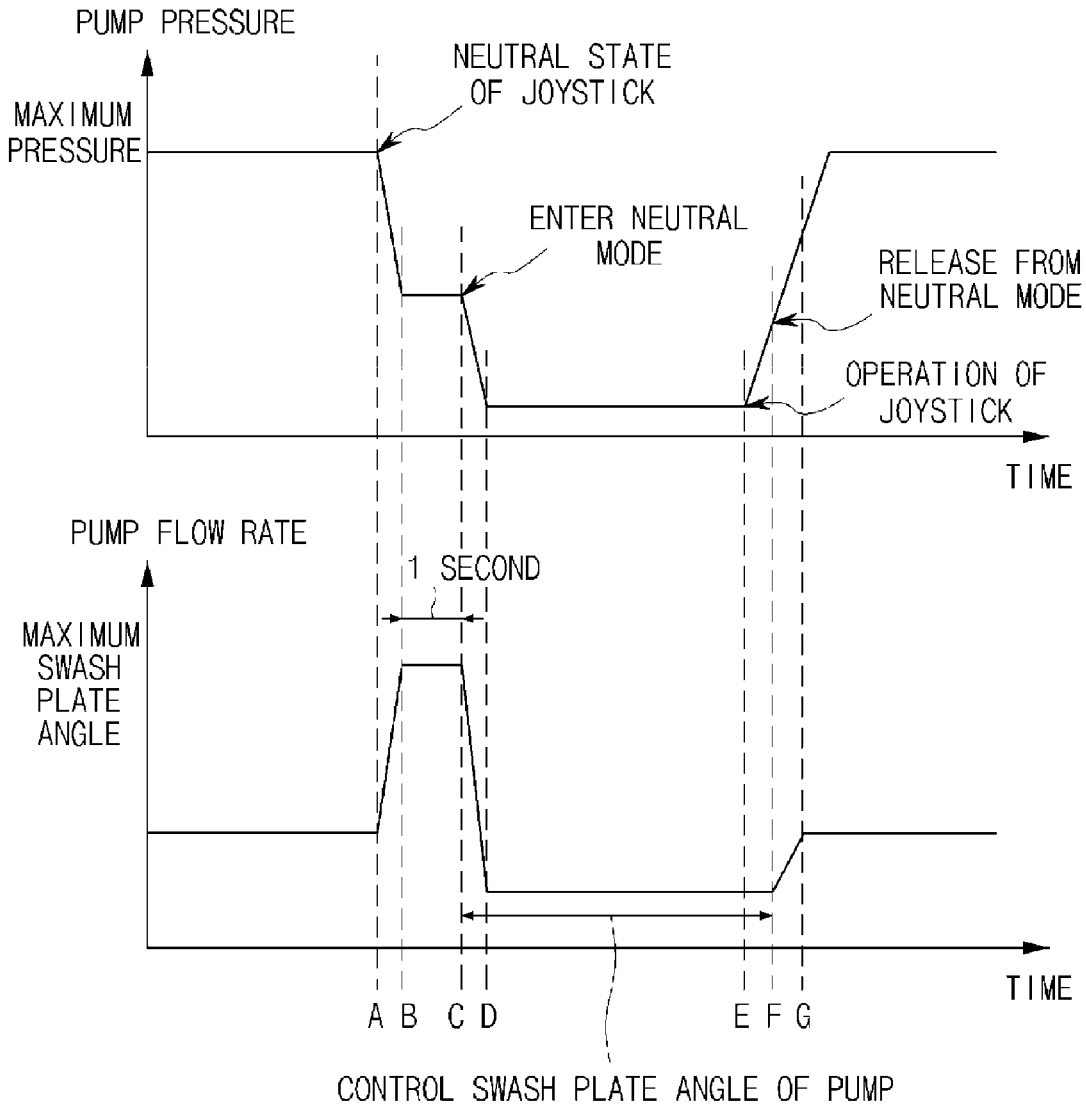
FIG. 4 is a graph illustrating a relationship between a pressure and a flow rate of the electronic hydraulic pump for a time in the system of FIG. 3.

A hydraulic system and an emergency control mode of FIGS. 3 and 4 are especially useful in a case where the operative amount of the joystick fails to be transmitted to the electronic control unit, compared to the hydraulic system and the emergency control mode of the construction machine illustrated in FIGS. 1 and 2. The useful system and control mode will be described in more detail below.

FIG. 3 is a hydraulic circuit diagram illustrating a hydraulic system 200 using electric hydraulic pumps according to an exemplary embodiment of the present disclosure. Referring to FIG. 3, the hydraulic system 200 for a construction machine includes electronic hydraulic pumps 110*a* and 110*b* driven by an engine (not illustrated), a plurality of main control valves 120*a*, 120*b*, 120*c*, and 120*d* controlling a movement of working oil discharged from the electronic hydraulic pumps, and travel motors 130*a* and 130*b* and a plurality of working machines 140*a* and 140*b* driven with working oil supplied from the respective main control valves. Further, the hydraulic system 200 for the construction machine includes hydraulic lines 114*a* and 114*b* forming paths, through which the working oil is transferred, by connecting the pumps, the main control valves, the working machines, and the like, and further includes a straight travel control valve 122 capable of changing a supply path of the working oil for the travel motors 130*a* and 130*b* and working machines 140*a* and 140*b* on an hydraulic line between the electronic hydraulic pumps 110*a* and 110*b* and the main control valves 120*a*, 120*b*, 120*c*, and 120*d*.

Further, the hydraulic system 200 for the construction machine includes adjusting devices 112*a* and 112*b* for adjusting swash plate angles of the electronic hydraulic pumps 110*a* and 110*b*, and an electronic control unit 150 capable of controlling the adjusting devices, and the electronic control unit 150 receives an operative amount of a joystick (for example, a pressure signal 162 from a pressure sensor 160) and flow rate signals (for example, angle detection signals of the swash plate angles) 116*a* and 116*b* of the respective hydraulic pumps 110*a* and 110*b* and outputs corresponding control signals 152*a* and 152*b* to the respective electronic hydraulic pumps 110*a* and 110*b*, particularly, the adjusting devices 112*a* and 112*b*.

Further, pressure sensors 180*a* and 180*b* detecting pressures of the working oil discharged from the respective electronic hydraulic pumps 110*a* and 110*b* are illustrated, and pump pressures 182*a* and 182*b* (pressures of the working oil discharged from the respective pumps) may be detected through the pressure sensors. The detected values are transmitted to the electronic control unit 150, and the electronic control unit 150 may control the respective electronic hydraulic pumps 110*a* and 110*b* based on the pressures.

Further, the hydraulic system 200 is operated as a close-type system in which center bypass valves 170*a* and 170*b* are closed. The working oil discharged from a hydraulic pump 110*c*, such as a separate gear pump, driven by the engine is transferred through a pilot line 114*c*, so that the center bypass valves 170*a* and 170*b* may be opened/closed depending on driving of a center bypass control valve 172, such as a solenoid valve, on the pilot line 114*c*. The center bypass control valve 172 may also be driven by receiving a control signal 154 from the electronic control unit 150.

For example, FIG. 3 illustrates a state where the center bypass valves 170*a* and 170*b* open the hydraulic lines 114*a* and 114*b* so that the hydraulic system 200 is switched to an opened type by blocking the supply of the working oil through the pilot line 114*c* by driving the center bypass control valve 172.

When an operative amount of the joystick (the pressure signal 162) fails to be transmitted to the electronic control unit 150 in the hydraulic system due to occurrence of a failure of a means (for example, the pressure sensor 160) transmitting the operative amount of the joystick to the electronic control unit, the electronic control unit 150 is not able to normally output the control signals 152*a* and 152*b* for the respective engines, and the electronic control unit 150 outputs control signals (pressure commands) with a predetermined constant to the respective electronic hydraulic pumps 110*a* and 110*b* during an abnormal operation.

In this case, differently from the case of FIG. 1, the electronic control unit performs the emergency control in a state where the hydraulic system 200 is switched to the opened-type system by opening the center bypass valves 170*a* and 170*b*. For example, the electronic control unit 150 may control whether to drive the center bypass valves 170*a* and 170*b* by outputting the control signal 154 to the center bypass control valve 172.

Next, FIG. 4 is a graph illustrating a relationship between a pressure and a flow rate of the electronic hydraulic pump for a time according to the exemplary embodiment of FIG. 3. An emergency control mode of the present disclosure will be described below with reference to FIG. 4.

For example, in a case where the operative amount of the joystick fails to be normally transmitted to the electronic control unit 150 (for example, in a case where the joystick pressure sensor 160 has a failure), during the emergency control of the electronic control unit 150, the electronic control unit 150 outputs a control signal with a predetermined constant to each electronic hydraulic pump in the opened-type system formed by opening the center bypass valves 170*a* and 170*b*, so that the working oil is set to be discharged at a maximum pressure. Accordingly, each electronic hydraulic pump maintains a high pressure, thereby performing load work.

In this case, the pump pressure (the discharge pressure of the working oil, for example, measured values of the pressure sensors 180*a* and 180*b*) is maintained at a maximum pressure, and a pump flow rate (a discharge flow rate of the working oil) is maintained with an appropriate flow rate (a swash plate angle) in accordance with the maximum pressure.

Thereafter, when the joystick is in the neutral state during the emergency control (see A of FIG. 4), the emergency driving of the working machine is stopped, so that the pump flow rate is changed to the maximum flow rate, and the pump pressure is changed to a predetermined pressure smaller than the maximum pressure (see B of FIG. 4). For example, the swash plate angle of the pump is maintained at a maximum swash plate angle, so that the pump discharges the maximum flow rate, and in this case, the pump pressure may be formed as approximately 70 bars.

Thereafter, when the pump flow rate is maintained as the maximum flow rate, that is, the maximum swash plate angle, for a predetermined reference time (for example, one second), and when the pump pressure in this case is equal to or larger than a predetermined reference pressure (for example, approximately 50 bars), the electronic control unit 150 determines that the joystick enters the neutral mode (see C of FIG. 4).

That is, when a specific condition, such as the maintenance of the maximum flow rate (the maximum swash plate angle), the predetermined reference time (for example, one second, and the predetermined reference pressure (for example, 50 bars or more), is satisfied, the electronic control unit 150 recognizes that the joystick does not accidently stay in the neutral state or is not slowly passing through the neutral state for another operation, but is intentionally in the neutral state and continuously maintains the neutral state.

Accordingly, according to the characteristic of the present disclosure, when the neutral state of the joystick is recognized, the electronic control unit 150 outputs the control signals to the adjusting devices of the respective electronic hydraulic pumps 110*a* and 110*b* to enter the "neutral mode" performing a predetermined control of a swash plate angle so that the respective electronic hydraulic pumps 110*a* and 110*b* discharge a predetermined flow rate (for example, approximately 50 LPM) of working oils.

When the electronic control unit 150 enters the neutral mode, the flow rate of the pump is decreased from the maximum flow rate to the predetermined flow rate (for example, 50 LPM) (see D of FIG. 4) to be maintained as a predetermined flow rate, and further, the pressure of the pump is decreased to the minimum pressure to be maintained until the joystick is operated again.

Accordingly, when the joystick is in the neutral state during the emergency control according to the characteristic of the present disclosure, the flow rate and the pressure of the pump are maintained with predetermined low values, respectively, contrary to the related art, so that it is possible to prevent the problem which occurs when the maximum pressure is continuously maintained in the related art. For example, it is possible to prevent the problems such as an increase in noise of the pump, and the like, a decrease in durability of the hydraulic components, such as the hydraulic pump or the valve, and an increase in fuel consumption, and a decrease in durability of an engine due to the engine in a continuous high load state.

Next, when the joystick is operated again during the predetermined control of the swash plate angle (for example, the neutral mode) (see E of FIG. 4), the pressure of the pump is gradually increased, and when the pressure of the pump is equal to or larger than a predetermined reference value (for example, approximately 70 bars), the electronic control unit 150 releases from the neutral mode (see F of FIG. 4).

When the control of the electronic control unit 150 releases from the neutral mode, the predetermined control of the swash plate angle (for example, the maintenance of the flow rate of approximately 50 LPM), which is being performed in the neutral mode, is stopped, and the control signals are output so that the respective electronic hydraulic pumps 110*a* and 110*b* discharge the working oil at the maximum pressure again (see G of FIG. 4).

As described above, the emergency control of the present disclosure, which is suggested for a case where the electronic control unit is not able to perform the normal control due to the failure of the transmittance of the operative amount of the joystick to the electronic control unit in the hydraulic system using the pressure control-type electronic hydraulic pumps, is mainly characterized by recognizing the case where the joystick is in the neutral state during the emergency control, and in this case, performing the emergency control in the neutral mode (for example, the predetermined control of the swash plate angle).

Further, to this end, the electronic control unit performs the emergency control in a state where the system is switched to the open type by opening the center bypass valves, so that it is possible to set a condition in which the neutral state of the joystick is easily recognized.

Further, as illustrated in FIG. 4, the electronic control unit clarifies a section in which the predetermined control of the swash plate angle (neutral mode) is performed, and a condition for entering and a condition for releasing from the neutral mode, so that the electronic control unit may drive the electronic hydraulic pump at an appropriate pressure and flow rate even during the emergency control.

As described above, the present disclosure relates to the hydraulic system for the construction machine using the electronic hydraulic pump, and particularly, the present disclosure is characterized by the hydraulic system, in which the electronic control unit may temporarily emergency control the respective electronic hydraulic pumps when the electronic control unit is not able to perform the normal control due to the problem of the failure of the transmittance of the operative amount of the joystick to the electronic control unit, and particularly, the electronic control unit performs the neutral mode (the predetermined control of the swash plate angle) of recognizing the neutral state of the joystick and permitting the respective electronic hydraulic pumps to discharge the working oil at the predetermined flow rate (for example, approximately 50 LPM) and the predetermined pressure (for example, the minimum pressure) during the neutral state of the joystick.

Further, in order to recognize the neutral state of the joystick and set the condition for entering and the condition for releasing from the neutral mode, the emergency control is performed in a state where the system, which is closed in the typical emergency control, is opened.

Further, in order to switch the state of the system to the open state, the electronic control unit opens the center bypass valves by driving the center bypass control valves (for example, the solenoid valves).

Therefore, according to the present disclosure, for example, in a situation in which the electronic control unit is not able to normally perform the control due to the failure of the normal transmittance of the operative amount of the joystick during the operation of the construction machine having the pressure control-type electronic hydraulic pumps, the system is opened by opening the center bypass valves, and then the electronic control unit performs the predetermined control of the swash plate angle on the respective electronic hydraulic pumps according to the condition for entering and the condition for releasing from the neutral mode, thereby efficiently performing the emergency control of the construction machine.

Further, the electronic control unit performs the neutral mode so that the respective electronic hydraulic pumps are driven at the predetermined flow rate and the predetermined pressure in the neutral state of the joystick, so that it is possible to solve a plurality of problems in the related art, such as an increase in noise generated according to the continuous maintenance of the maximum pressure of the pump regardless of the neutral state of the joystick and the maintenance of the maximum pressure, a decrease in durability of the hydraulic components, and an increase in fuel consumption and a decrease in durability of the engine due to a continuous high load state of the engine.

The hydraulic system for the construction machine according to the present disclosure may be used for temporarily driving the construction machine when an operation of an electronic control unit for controlling electronic hydraulic pumps is abnormal, particularly, the electronic control unit is not able to perform a control because an operative amount of a joystick input to the electronic control unit fails to be normally transferred.

Although the present disclosure has been described with reference to exemplary and preferred embodiments, workers skilled in the art will recognize that changes may be made in form and detail without departing from the spirit and scope of the disclosure.

The invention claimed is:

1. A hydraulic system for a construction machine, comprising:

a plurality of electronic hydraulic pumps, which are pressure control type variable capacity pumps;

a plurality of main control valves configured to selectively control a movement of working oil discharged from the plurality of electronic hydraulic pumps;

a plurality of working machines and travel motors, each of the plurality of working machines and travel motors driven with working oil supplied from a respective one main control valve of the plurality of main control valves; and an electronic control unit configured to control a discharge flow rate of the working oil discharged from the plurality of electronic hydraulic pumps based on flow rate signals of the plurality of electronic hydraulic pumps and an output signal from a joystick, wherein when the electronic control unit is not able to perform a normal control due to a failure of transmittance of the output signal from the joystick to the electronic control unit, the electronic control unit is configured to perform an emergency control of permitting the plurality of electronic hydraulic pumps to discharge the working oil with a maximum pressure by outputting predetermined pressure control signals to the plurality of electronic hydraulic pumps, and the electronic control unit is configured to perform a predetermined control of a swash plate angle that permits the plurality of electronic hydraulic pumps to discharge the working oil at a predetermined flow rate and at a minimum pressure when the joystick is in a neutral state during the emergency control.

2. The hydraulic system of claim 1, further comprising:

a plurality of center bypass valves closed during the normal control of the electronic control unit, wherein the electronic control unit is configured to switch a type of the hydraulic system to an open type system by operating the plurality of center bypass valves when the electronic control unit performs the emergency control.

3. The hydraulic system of claim 2, wherein during a switch to the open type system and when the plurality of the electronic hydraulic pumps has a pressure equal to or higher than a predetermined reference pressure and maintains a maximum swash plate angle for a predetermined reference time, the electronic control unit is configured to recognize that the joystick is in the neutral state.

4. The hydraulic system of claim 1, wherein the predetermined control of the swash plate angle is performed so that respective pressures of the working oil discharged from the plurality of electronic hydraulic pumps become the minimum pressure by permitting the plurality of electronic hydraulic pumps to discharge working oil at the predetermined flow rate according to a recognition of the neutral state of the joystick.

5. The hydraulic system of claim 4, wherein according to a release from the neutral state of the joystick, the respective pressures of the working oil discharged from the plurality of electronic hydraulic pumps are increased, and when the increased pressure is equal to or higher than a predetermined pressure, the electronic control unit is configured to stop the predetermined control of the swash plate angle to permit the plurality of electronic hydraulic pumps to discharge the working oil at the maximum pressure.

* * * * *